United States Patent [19]

De Vynck et al.

[11] Patent Number: 4,727,928

[45] Date of Patent: Mar. 1, 1988

[54] PROCESS FOR THE PREPARATION OF REFINED TANTALUM OR NIOBIUM

[75] Inventors: Ivan A. De Vynck, Ghent; Pierre D. E. De Backer, Wilrijk, both of Belgium

[73] Assignee: Metallurgie Hoboken-Overpelt, Hoboken, Belgium

[21] Appl. No.: 883,496

[22] Filed: Jul. 8, 1986

[30] Foreign Application Priority Data

Sep. 23, 1985 [LU] Luxembourg ..... 86090

[51] Int. Cl.[4] ..... B22D 11/00; C22B 34/00

[52] U.S. Cl. ..... 164/469; 164/494; 75/65 EB; 75/65 ZM; 75/84

[58] Field of Search ..... 164/469, 494, 492, 266; 75/84, 65 EB, 65 ZM

[56] References Cited

U.S. PATENT DOCUMENTS

| | | | |
|---|---|---|---|
| 3,342,250 | 9/1967 | Treppshuhe et al. | 164/495 |
| 3,343,828 | 9/1967 | Hunt | 164/494 |
| 3,425,826 | 2/1969 | Schmidt et al. | 164/494 |
| 3,547,622 | 12/1970 | Hutchinson | 164/494 |
| 3,838,288 | 9/1974 | Stolz et al. | 219/121 EB |
| 3,894,573 | 7/1975 | Paton et al. | 164/469 |
| 4,518,418 | 5/1985 | Fletcher et al. | 164/494 |
| 4,627,148 | 12/1986 | Imahashi et al. | 164/495 |

FOREIGN PATENT DOCUMENTS

| | | | |
|---|---|---|---|
| 936875 | 9/1963 | United Kingdom | 164/494 |
| 1388380 | 3/1975 | United Kingdom | 164/494 |
| 2118208 | 10/1983 | United Kingdom | 164/494 |
| 2117412 | 10/1983 | United Kingdom | 164/494 |

OTHER PUBLICATIONS

Chemical Abstracts, vol. 67, 1967, p. 5339; abstract 72f.

Chemical Abstracts, vol. 96, 1982, p. 264; abstract 73011w.

Chemical Abstracts, vol. 99, 1983, p. 255; abstract 126768u.

Chemical Abstracts, vol. 100, 1984, p. 271; abstract 72690f.

Journal of Metals, index to vol. 18, Dec. 1966, p. 1303–1308.

*Primary Examiner*—Nicholas P. Godici
*Assistant Examiner*—Samuel M. Heinrich
*Attorney, Agent, or Firm*—Fred Philpitt

[57] ABSTRACT

Tantalum or niobium in the form of powder or pieces containing volatile impurities, e.g. sodiothermic tantalum powder, is first converted into crude cast metal by plasma melting and then the crude cast metal is refined by electron beam melting.

6 Claims, No Drawings

PROCESS FOR THE PREPARATION OF REFINED TANTALUM OR NIOBIUM

The present invention relates to a process for the preparation of refined metal, this metal being tantalum or niobium, from a starting material composed of this metal in the form of powder or pieces containing volatile impurities, according to which the starting material is first converted into crude cast metal that is submitted afterwards to at least one electron beam melting in order to produce refined cast metal.

The process of the invention is particularly interesting to prepare high purity tantalum starting from sodiothermic tantalum powders and from scrap of tantalum anodes for condensers.

In a known process of the above defined type, a sodiothermic tantalum powder is first converted into crude cast tantalum by compacting the powder and by submitting the compacted powder to an electron beam melting. The drawback of this known process is that the electron beam melting in this particular case is slow and expensive. This is due to the fact that impurities are vaporized at the melting, thereby increasing the pressure in the furnace in which the operation is carried out. Since this furnace requires a very high vacuum to be able to operate, the result is that the furnace can only be operated at about one third of its power and that in spite of this it still comes often to a standstill awaiting the required vacuum to be restored, which makes that finally it actually runs for only a small fraction of time.

In an other known process of the above defined type a sodiothermic tantalum powder is first converted into crude cast tantalum by submitting the powder to a degassing under vacuum in an induction furnace, by compacting the degassed powder and submitting the compacted powder to an electron beam melting. This melting can now be made at a normal rate, since the degassing under vacuum freed the material to be melted from its volatile impurities. This process has the drawback, however, to be expensive, since it requires a degassing under vacuum and an electron beam melting to yield crude cast tantalum.

The aim of the present invention is to provide a process as defined before, that avoids the drawbacks of the known processes.

According to the invention, in order to convert the starting material into crude cast metal this material is melted as such or in compacted state by contact with a plasma of a gas that is inert towards the metal. This way of converting the starting material into crude cast metal is much less expensive than those used in the aforesaid known processes, because it doesn't require a vacuum.

It should be noted that in the process of the invention a crude cast metal is obtained that is much less pure than that one obtained in the aforementioned known processes. The applicant found, however, that this comparatively impure crude cast metal obtained as an intermediate product in the process of the invention is as easy to convert by electron beam melting into refined cast metal as the comparatively pure crude cast metal obtained as an intermediate product in the beforementioned known processes, which is quite surprising.

In the process of the invention a noble gas is preferably used as a gas that is inert towards the metal to be melted. Good results are achieved with a plasma composed of argon, helium or of a mixture of argon and helium, for instance a mixture with a volume ratio argon : helium from 0,2 to 0,8.

EXAMPLE 1

This example relates to the preparation of high purity tantalum from a sodiothermic tantalum powder by the process of the invention.

The starting powder has the following analysis, in ppm : 49 C, 2700 $O_2$, 84 $N_2$, 75 $H_2$, 1438 S, 90 Na, 2430 K, 150 Fe.

The powder is compacted into a cylindric bar of 50 mm diameter by isostatic compression at 45,000 psi.

The bar is melted in a plasma furnace. The furnace is heated by three plasma torches, which are aimed on a melting zone, the vertical planes, in which the torches are located, forming among each other angles of 120°. The torches are of the ARCOS PJ 139 type; they operate in non-transferred mode and each of them has a power of 22.5 kW. Between the torches, used as electrodes, a three-phase alternating current is superposed in order to increase by 21.7 kW the energy contained in the plasma. The overall power reaches thus 82.2 kW. The plasmageneous gas is composed of a mixture of argon and helium with 33 volume % of argon. This gas is fed at a flow of 55 Nl/minute. The same gas is used to expel the air from the furnace before the beginning of the melting operation. As soon as the air is expelled from the furnace the torched are ignited, thereby generating a very hot melting zone. The lower end of the bar to be melted is brought in this melting zone, where through the high temperature of the plasma the tantalum melts drop by drop and the bar is lowered progressively as it melts. The molten tantalum flows in a cooled copper crucible, provided with a retractable bottom. As the filling of the crucible proceeds, the bottom of this crucible is lowered and a crude tantalum ingot is so formed. The melting race is 25.3 kg Ta per hour and the energy consumption 3.5 kWh/kg Ta.

The so obtained crude cast tantalum has the following analysis, in ppm: 13 C, 2100 $O_2$, 30 $N_2$, 4 $H_2$, 7 S, <2 Na, <5 K, 52 Fe.

The so obtained crude cast tantalum is melted again in an electron beam furnace, the melting rate being 160 kg of tantalum per hour and the energy consumption 2.6 kWh/kg Ta. So, an ingot is obtained containing, in ppm: 14 C, 139 $O_2$, 28 $N_2$, 1 $H_2$, <1 S, <2 Na, <5 K, 25 Fe. This metal is pure enough for some applications.

If one wishes to produce extra pure tantalum, the ingot is melted once more in the same conditions, whereby producing an ingot containing, in ppm: 12 C, 63 $O_2$, 20 $N_2$, <1 $H_2$, <1 S, <2 Na, <5 K, <10 Fe.

EXAMPLE 2

This example relates to the preparation of high purity tantalum from a sodiothermic tantalum powder by the process of the prior art, mentioned herebefore in the first place.

The starting powder has the same composition as the one used in example 1 and it is compacted into a cylindric bar in the same way as in example 1.

The bar is melted in an electron beam furnace. By melting as quick as possible, the melting rate reaches 10.4 kg Ta per hour and the energy consumption 28.8 kWh/kg Ta.

The so obtained crude cast tantalum has the following analysis, in ppm: 8 C, 565 $O_2$, 35 $N_2$, <1 $H_2$, <1 S, <2 Na, <5 K, 35 Fe.

A first remelting of this metal, carried out in the same conditions as the remeltings carried out in example 1, produces tantalum containing, in ppm: 7 C, 101 $O_2$, 36 $N_2$, <1 $H_2$, <1 S, <2 Na, <5 K, <10 Fe.

A second remelting carried out in the same conditions as the first one then produces tantalum containing, in ppm: 5 C, 59 $O_2$, 25 $N_2$, <1 $H_2$, <1 S, <2 Na, <5 K, <10 Fe.

When comparing the examples 1 and 2, it is noticed that the melting rate of the compacted starting material achieved in example 1 is 2.5 times higher than that one achieved in example 2, whereas the energy consumption for this melting in example 1 is 8 times lower than that one consumed in example 2. It is noticed as well that the compositions of the metals obtained in both examples by one remelting of the crude cast tantalum in the electron beam furnace are comparable and that this is also the case for the metals obtained by a double remelting of the crude cast tantalum, although the crude cast tantalum of example 1 is much less pure than that one of example 2 and although all remeltings have been carried out in the same conditions.

We claim:

1. A process for the preparation of refined metal, this metal being tantalum or niobium, from a starting material composed of this metal in the form of powder or pieces containing volatile impurities, comprising the steps of (a) melting the starting material as such or in compacted state by contacting it with a plasma of a gas, that is inert towards said metal, in order to convert the starting material into crude cast metal; and (b) submitting said crude cast metal to at least one electron beam melting to produce refined cast metal.

2. The process according to claim 1 wherein a noble gas is used as a gas that is inert towards the metal.

3. The process according to claim 2 wherein a noble gas containing argon is used.

4. The process according to claim 2 wherein a noble gas containing helium is used.

5. The process according to claim 2 wherein a mixture of argon and helium is used as a noble gas.

6. The process according to claim 5 wherein the volume ratio argon : helium goes from 0.2 to 0.8.

* * * * *